US006789644B2

(12) United States Patent
Mukaida

(10) Patent No.: US 6,789,644 B2
(45) Date of Patent: Sep. 14, 2004

(54) ENGINE MUFFLER

(75) Inventor: Hidenori Mukaida, Tokyo (JP)

(73) Assignee: Hiraoka Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/985,856

(22) Filed: Nov. 6, 2001

(65) Prior Publication Data

US 2003/0085072 A1 May 8, 2003

(51) Int. Cl.[7] ..... F01N 1/08

(52) U.S. Cl. ..... 181/272; 181/273; 181/275; 181/276; 181/212; 181/255; 181/256

(58) Field of Search ..... 181/272, 273, 181/275, 276, 212, 213, 230, 255, 256

(56) References Cited

U.S. PATENT DOCUMENTS

| | | | | |
|---|---|---|---|---|
| 4,890,690 A | * | 1/1990 | Fischer et al. | 181/240 |
| 5,521,339 A | | 5/1996 | Despain et al. | |
| 5,738,184 A | * | 4/1998 | Masuda et al. | 181/262 |
| 5,857,327 A | | 1/1999 | Sato et al. | |
| 6,250,075 B1 | * | 6/2001 | Funakoshi et al. | 60/299 |

FOREIGN PATENT DOCUMENTS

| | | |
|---|---|---|
| JP | 2000-018028 A | 1/2000 |
| WO | WO 99/17007 A1 | 4/1999 |

* cited by examiner

*Primary Examiner*—Shih-Yung Hsieh
(74) *Attorney, Agent, or Firm*—Sughrue Mion, PLLC

(57) ABSTRACT

In the engine muffler including a first expansion chamber 12 of the exhaust gas having an exhaust gas inlet aperture 11 connecting to an exhaust gas outlet of the engine, a second expansion chamber 14 having an exhaust gas outlet aperture 13, at least one first exhaust gas purifier 15 coated wit a catalyst to purify the exhaust gas purifier provided with innumerable numbers of small holes, a wall side of said second expansion chamber 14 to which the engine is not installed is formed to a double-wall construction of walls 14*a* and 14*b* with a predetermined distance, further, the double-wall is packed with a heat insulating material to improve the purification efficiency, heat insulation and sound elimination. Heated muffler wall is decreased. It is also possible by applying a detachable construction to take out the first exhaust gas purifier outside the wall for replacement or cleaning. If there is no particular restriction in the gas purification concentration degree existed a catalyst is not applied to the exhaust gas purifier.

3 Claims, 16 Drawing Sheets

ENGINE MUFFLER

BACKGROUND OF THE INVENTION

1. Field of the Invention

The present invention relates to a muffler applied for smaller engines.

2. Prior Art

Mufflers applied for the smaller engines used in conventional brush cutters or chain saws are constructed such that, as shown in FIG. 1, an exhaust gas first expansion chamber 2 having an exhaust gas inlet 1 connecting to an exhaust gas outlet of the engine (not shown in the figure) and an exhaust gas second expansion chamber 4 having an exhaust gas outlet 3, the first expansion chamber 2 and the second expansion chamber 4 being separated by a partition board, a part of the partition board being removed to install an exhaust gas purifier 5 made of stainless steel and coated with a catalyst to purify the gas passing through the purifier 5. Said purifier is provided with innumerable numbers of honeycomb-like small holes.

Another conventional mufflers are constructed such that, as shown in FIG. 2, the exhaust gas first expansion chamber 2 having the exhaust gas inlet 1 connecting to the exhaust gas outlet of the engine and the exhaust gas second expansion chamber 4 having an exhaust gas outlet 3, an exhaust gas receiver 6 located in the first expansion chamber 2 and one end of the exhaust gas receiver 6 is closed and the other end of which being opened, said exhaust gas receiver 6 being provided with a plurality of through holes 6*b* and the open end of which being placed facing to the exhaust gas inlet 1 in the first expansion chamber 2 and the first expansion chamber and the second expansion chamber 4 being separated with a partition board, one part of the partition board being removed and an exhaust gas purifier 5 made of stainless steel and coated with a catalyst to purify the exhaust gas passing through the honeycomb small holes is applied.

In conventional engine mufflers shown in FIG. 1, an exhaust gas of the engine is introduced into the first gas expansion chamber 2 through the gas inlet 1, passing through the exhaust gas purifier 5 provided in the chamber and the exhaust gas is introduced into the second expansion chamber 4 and the gas is exhausted to the atmosphere through the exhaust gas outlet 3. Accordingly, an outside wall 2*a* of the first expansion chamber 2 and an outside wall 4*a* of the second expansion chamber 4 are heated up to approximately 700~800° C. by the heat of the exhaust gas. When the muffler is installed to the engine it is required to provide a metallic cover plate 7 at a position with a predetermined distance from the outside wall 4*a* and further it is required to install a heat durable plastic cover plate 8 at a position with another predetermined distance from the metallic cover plate 7. Accordingly, an exterior shape of the muffler becomes larger against a tendency to make the engine assembly smaller.

In the muffler illustrated in FIG. 2, one open end of the exhaust gas receiver 6 provided with a plurality of gas through holes 6*b* on a cylindrical surface 6*a* is placed facing to the exhaust gas inlet 1 to increase an efficiency to absorb the sound of the muffler. Incomplete combustion gasses are burnt and generation of unfavorable carbon monoxide or nitrogen oxides is controlled. Even such improvement has been added, since the outside wall 2*a* of the first expansion chamber 2 and an outside wall 4*a* of the second expansion chamber 4 are heated by the exhaust gas up to approximately 700~800° C., the metallic cover plate 7 must be added at a location with a predetermined distance from the outside wall 4*a* of the muffler and further the heat durable plastic cover 8 is required at a location with a predetermined distance from the metallic cover plate 7. The engine assembly including the muffler becomes larger against the tendency to make the engine assembly smaller.

The present invention is to offer an improved engine muffler to keep the outside wall of the second expansion chamber not to become hotter.

SUMMARY OF THE INVENTION

The present invention is explained with reference to FIG. 3. A muffler provided with a first expansion chamber 12 of the exhaust gas provided with an exhaust gas inlet 11 connecting to an exhaust gas outlet aperture of the 2 cycle or the 4 cycle engine, a second expansion chamber 14 provided with a gas exhaust outlet 13, the first expansion chamber 12 and the second expansion chamber 14 are separated with a partition board 20, a part of which being cut out to place a first exhaust gas purifier 15 coated with a catalyst to purify the exhaust gas, the purifier 15 is provided with innumerable numbers of small holes. The wall that does not face to the engine of said second expansion chamber 14 is made as a double-wall construction having a wall 14*a* and a wall 14*b* with a predetermined distance between them. It is of course possible to have a double wall construction having a wall 12*a* and a wall 12*b* as shown in FIG. 4A.

It goes without saying that a catalyst is not applied to the first exhaust gas purifier if there is no particular restriction in the gas purification concentration degree. This case is shown in FIG. 4B.

The muffler is also explained with reference to FIG. 5A that the double walls 12*a* and 12*b*, 14*a* and 14*b* are packed with a heat insulating material to enhance the heat insulating efficiency.

It goes without saying that a catalyst is not applied to the first exhaust gas purifier if there is no particular restriction in the gas purification concentration degree. This case is shown in FIG. 5B.

The engine muffler is also devised as illustrated with reference to FIG. 6. A cover plate 17 provided with one open aperture at a place surrounding the exhaust gas purifier 15 in the first expansion chamber 12 for the engine of 2 cycle or 4 cycle type illustrated in FIG. 3 and another cover plate 17' surrounding said gas purifier 15 in the second expansion chamber 14 provided with one open aperture at a place surrounding the exhaust gas purifier 15 in the second expansion room 14 are added. In such a manner, a gas introducing aperture is provided in the first expansion chamber 12 and a gas exhausting aperture is provided in the second expansion chamber 14. Thus, the flow of gas is rectified to store the heat within the cover pate 17 and the cover plate 17' to prevent the heat from being transferred to the outside walls.

It goes without saying that a production process becomes easier if the partition board 20 and the cover plate 17 located in the first expansion chamber 12 are manufactured in an integral molding manner.

The engine muffler is also illustrated with reference to FIG. 7. Said engine muffler is an improved ones shown in FIG. 3 and FIG. 6. Apart of the double walls 14*a* and 14*b* in the second expansion chamber 14 is removed to provide an open aperture 14*c* through which the exhaust gas is partly released outside. The outside wall 14' is fastened to a cover plate 19 with a bolt and a nut. Further, a cover plate 17' for the exhaust gas purifier 15 in the second expansion chamber 14 is fastened to the partition board 20 with a bolt and a nut. If required, the cover plates 14' and 17' are unfastened to take out the exhaust gas purifier 15 for replacement or cleaning. This model change is done to assist the life of the exhaust gas purifier 15.

A distance between the cover plate 17 in the first expansion chamber 12 and the exhaust gas purifier 15 is widened. Meanwhile, a distance between the cover plate 17' in the second expansion chamber 14 and both sides of the exhaust gas purifier 15 is made nil. By this construction it becomes easier to take out the exhaust gas purifier 15 from the second expansion chamber 14. It is also easy to put back the exhaust gas purifier 15 to the place where it is located in the first expansion chamber 12.

The muffler illustrated in FIG. 4A is reconstructed to have the cover plates 17 and 17' as illustrated in FIG. 8. It is also reconstructed to have the double walls construction such as walls 12*a*, 12*b* and 14*a*, 14*b*.

The muffler in FIG. 9 is made to have the double walls 12*a*, 12*b* and 14*a*, 14*b* and packed with the heat insulating material 16 to improve the heat insulating efficiency much more.

The muffler in FIG. 10 is provided with a second exhaust gas purifier 18 to the muffler shown in FIG. 4A to improve exhaust gas purification efficiency, to eliminate muffler's sound and to improve the heat insulation efficiency.

The muffler in FIG. 11 is provided with an improved second exhaust gas purifier 18. The purifier 18 is located nearer the exhaust gas inlet 11.

The muffler in FIG. 12 is manufactured to have its closed end of the second exhaust gas purifier 18 welded onto the partition board 20. The heat insulation material 16 is packed between the walls 12*a*, 12*b* and 14*a*, 14*b*, respectively.

The muffler in FIG. 13 is an improved ones by covering the circumference of the first exhaust gas purifier 15 with the cover plates 17 and 17' of the muffler shown in FIG. 12.

The muffler in FIG. 14 is packed with the heat insulating material 16 between the walls 12*a*, 12*b* and 14*a*, 14*b* shown in FIG. 13.

DETAILED EXPLANATION OF THE PREFERRED EMBODIMENTS OF THE INVENTION

The drawings FIGS. 3~14 are made to illustrate a configuration of the engine muffler, a flow passage of the exhaust gas, configuration and location of the apertures according to the present invention.

Now an example of the engine muffler according to the present invention is explained with reference to the accompanied drawings FIG. 3 and FIG. 4A.

Figure 1:
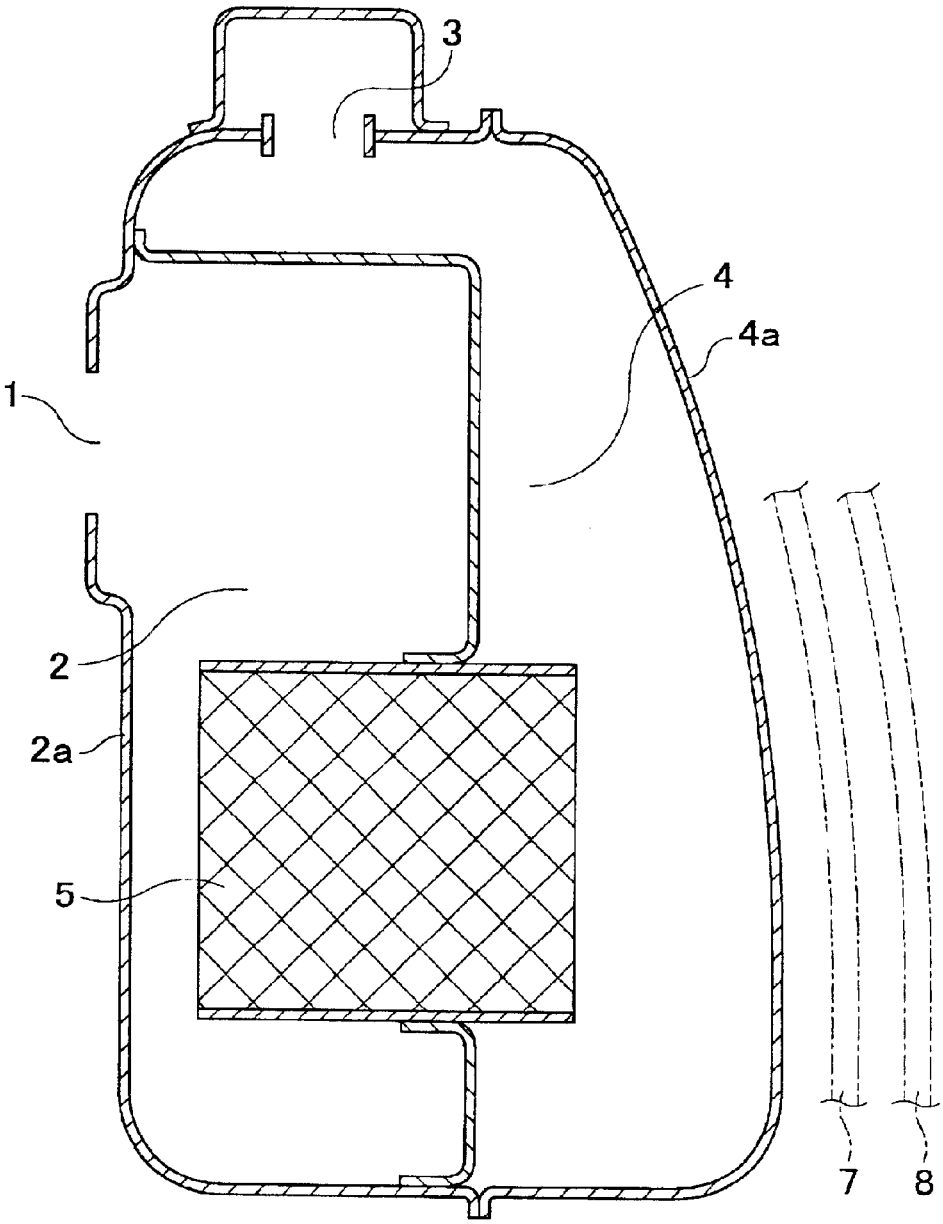
FIG. 1 PRIOR ART
FIG. 1 is a vertical cross sectional view of the conventional engine muffler.
Figure 2:
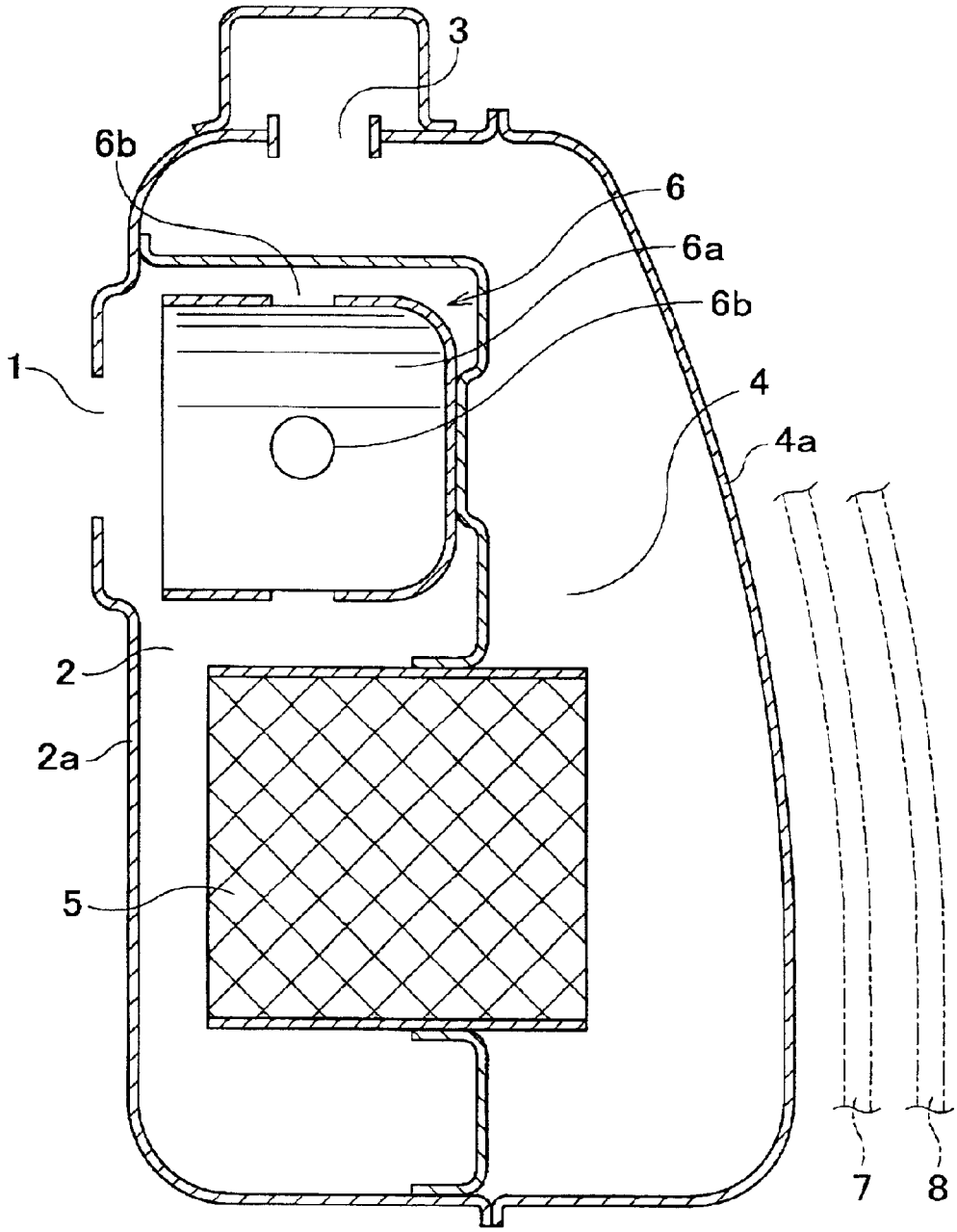
FIG.2 PRIOR ART
FIG. 2 is a vertical cross sectional view of the conventional engine muffler.
Figure 3:
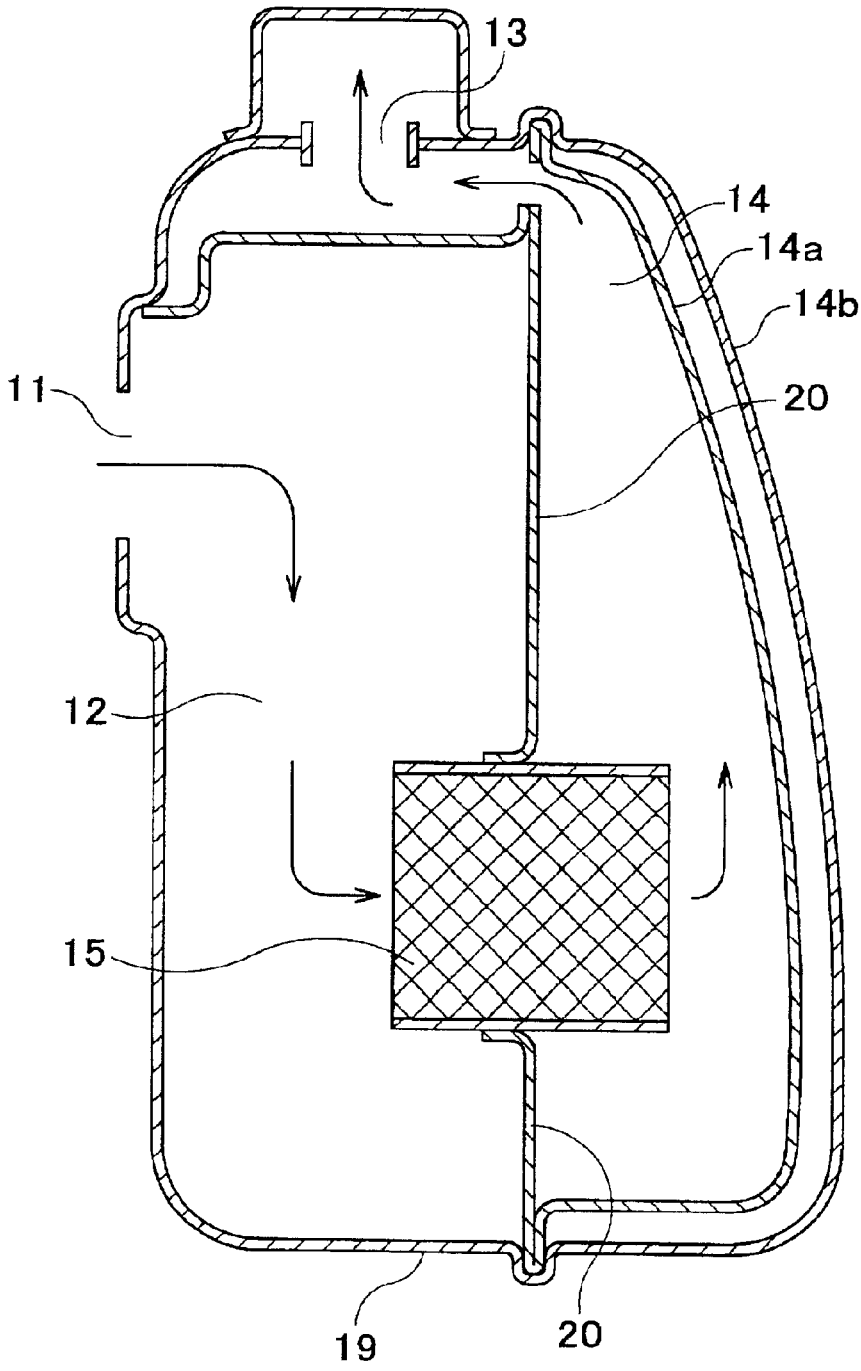
FIG. 3 is a vertical cross sectional view disclosed in claim 1 according to the present invention.

In FIG. 3, a muffler body 19 is partitioned with a partition board 20 and a first expansion chamber 12 and a second expansion chamber 14 are formed, respectively. An exhaust gas inlet 11 connecting to a gas exhaust outlet (not shown) of the 2 cycle or the 4 cycle engine is provided in an upper part of the first expansion chamber 12 shown to the left side of the second expansion chamber 14. Meanwhile, an exhaust gas outlet 13 is provided in an upper part of the second expansion chamber 14 shown in the right side of the first expansion chamber 12.

At least one first exhaust gas purifier 15 coated with a catalyst such as platinum or rhodium, etc. is provided. The first exhaust gas purifier 15 is made of stainless steel and has honeycomb like small holes. The first exhaust gas purifier 15 is located between the first expansion chamber 12 and the second expansion chamber 14. Double walls 14*a* and 14*b* with a predetermined distance between them and located in said second expansion chamber 14 which is not the side to face to the engine are added. Further, as shown in FIG. 4A, the walls which directly face to the engine in the first expansion chamber 12 are manufactured to improve the heat insulating efficiency. If there is no particular restriction in the exhaust gas purification concentration degree existed, a catalyst in the honeycomb purifier is not necessarily applied as shown in FIG. 4B.

Figure 4A:
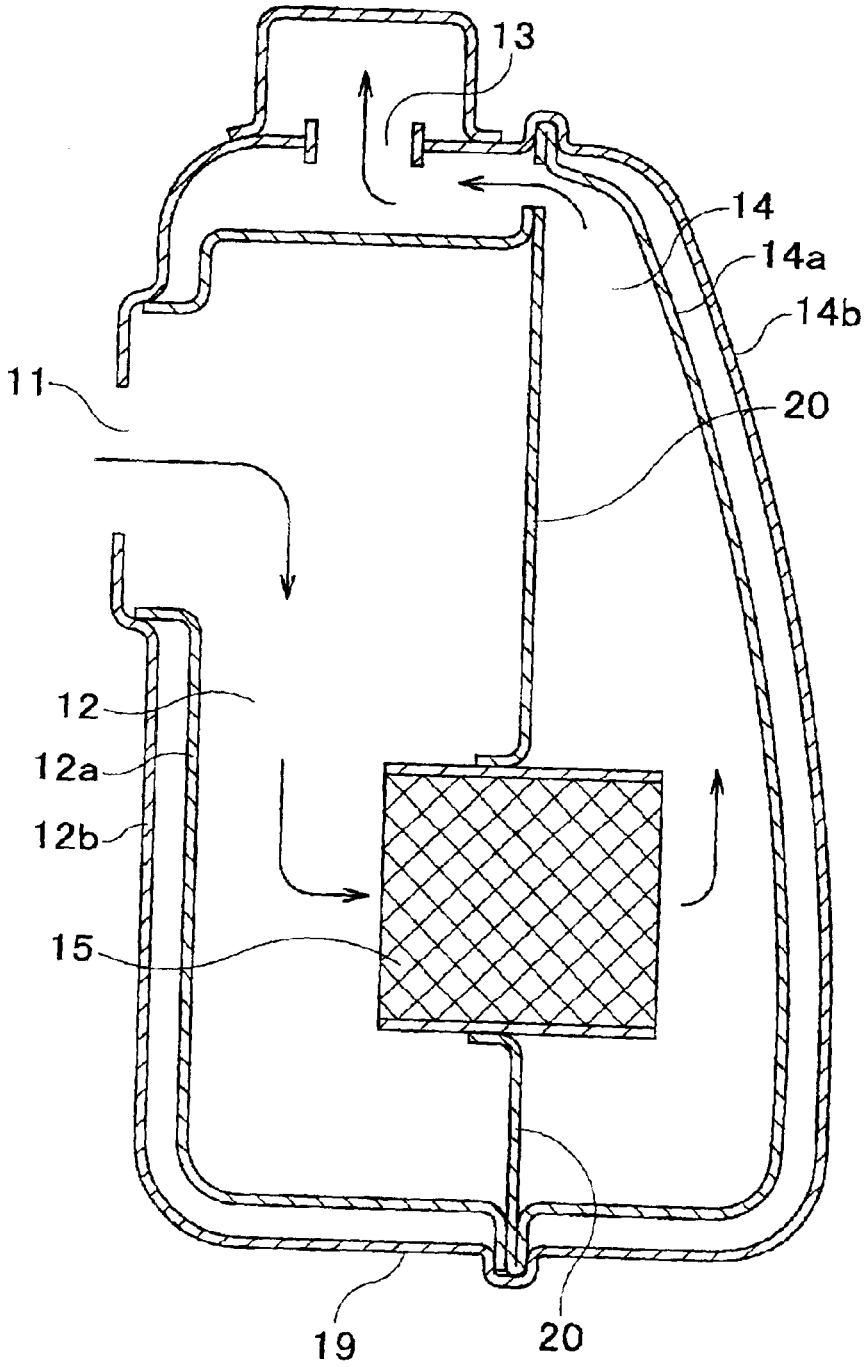
FIG. 4A is a vertical cross sectional view of the engine muffler of other embodiment according to the present invention.
Figure 5A:
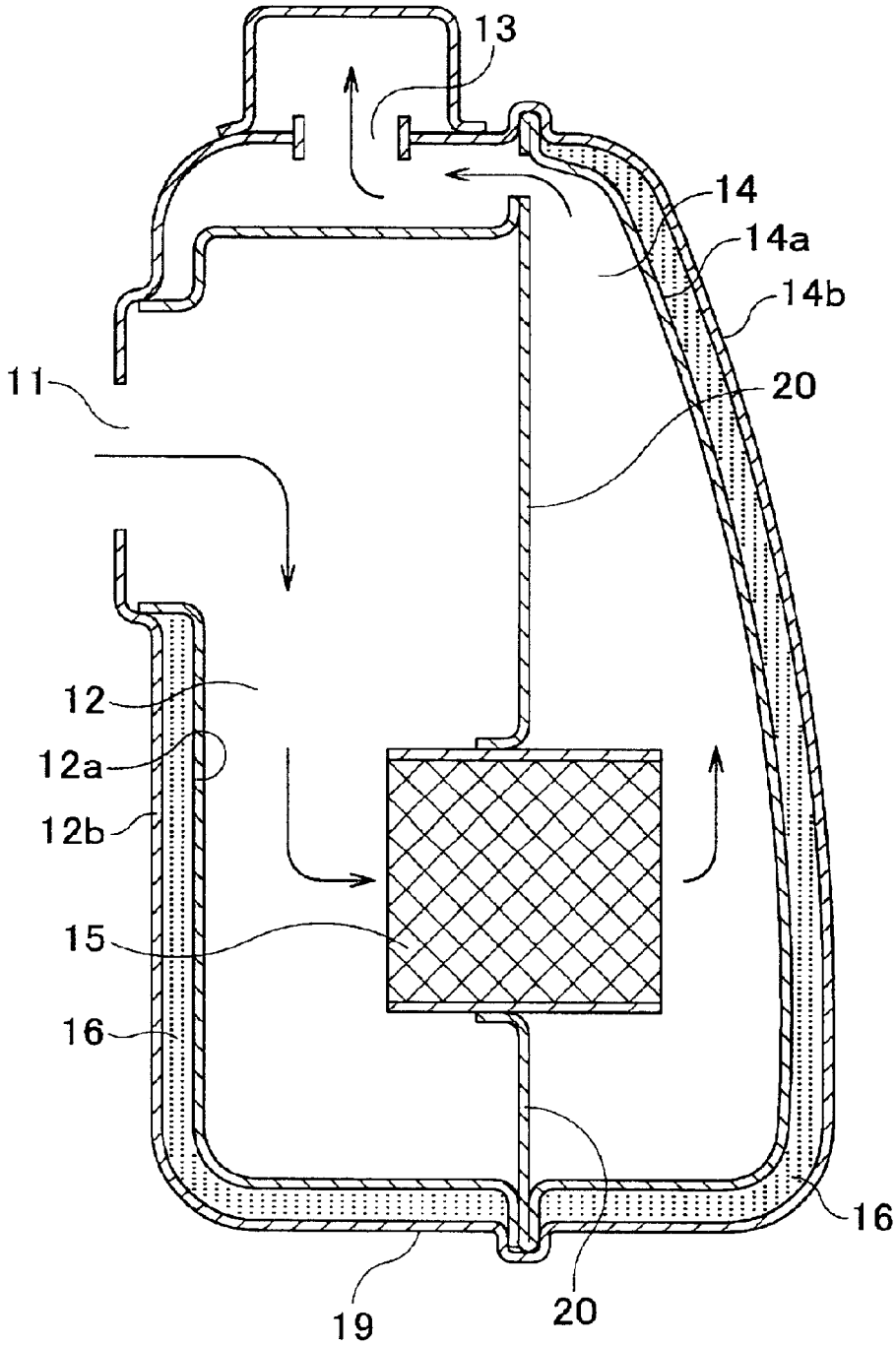
FIG. 5A is a vertical cross sectional view of the engine muffler of other embodiment according to the present invention.

The construction shown in FIG. 5A is the one that the heat insulating material is packed between the double walls 12*a*, 12*b* and 14*a*, 14*b* as illustrated in FIG. 4A.

Figure 4B:
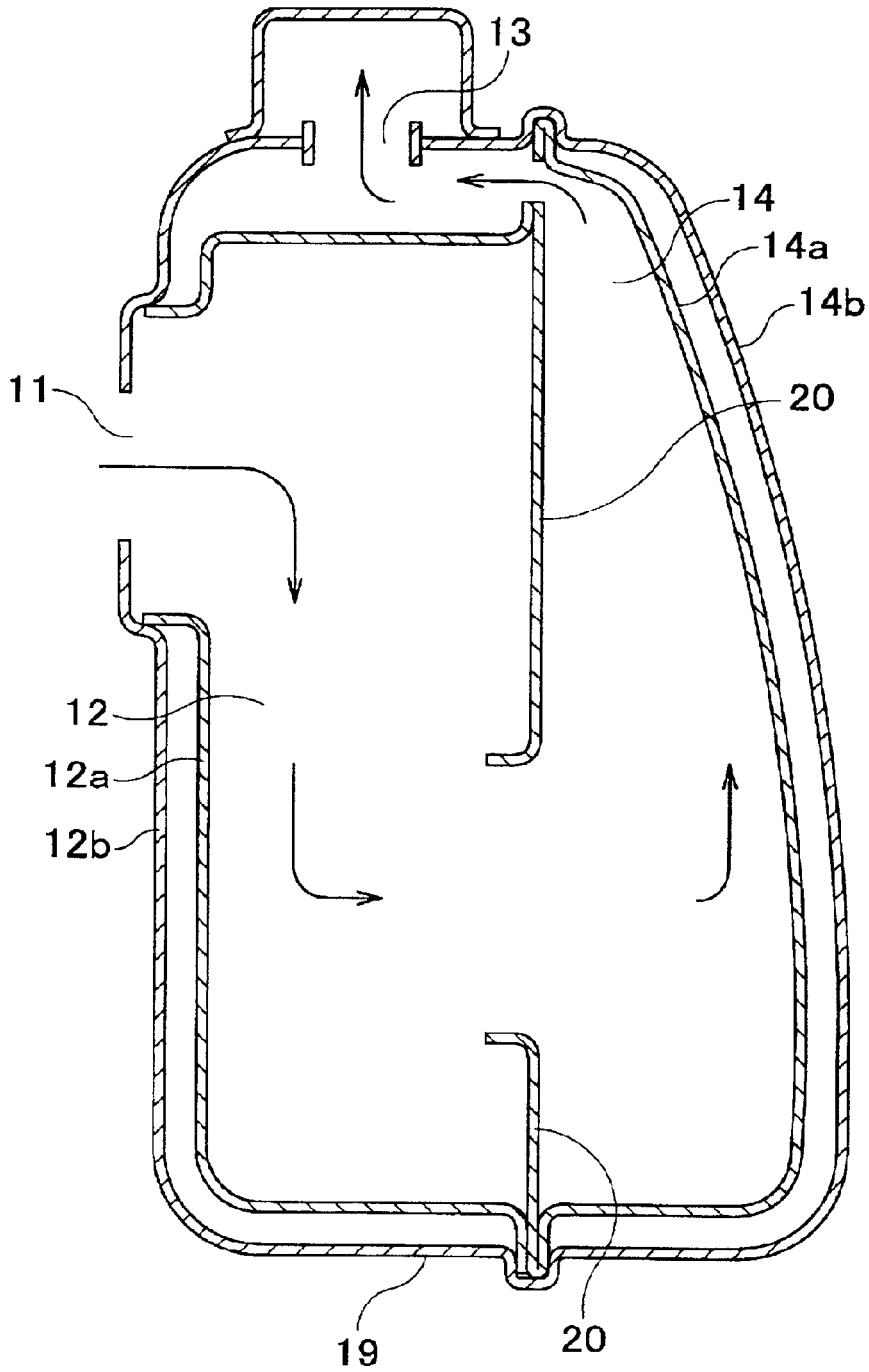
FIG. 4B is a vertical cross sectional view of the engine muffler of another embodiment according to the present invention when there is no particular restriction in gas purification concentration degree.
Figure 5B:
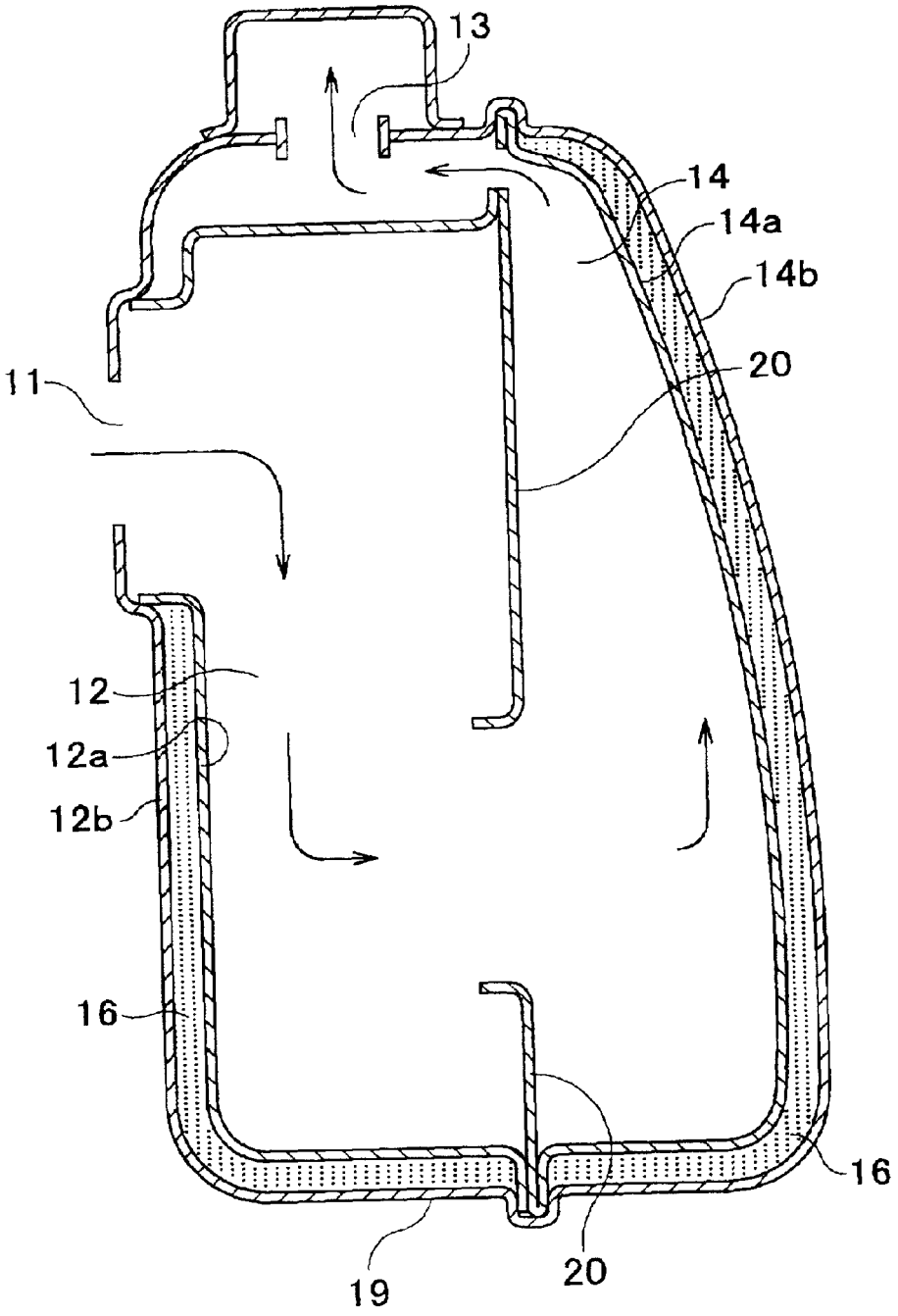
FIG. 5B is a vertical cross sectional view of the engine muffler of another embodiment according to the present invention when there is no particular restriction in gas purification concentration degree existed.

The construction illustrated in FIG. 5B is the one that the heat insulating material is packed between the double walls 12*a*, 12*b* and 14*a*, 14*b* as illustrated in FIG. 4B.

Figure 6:
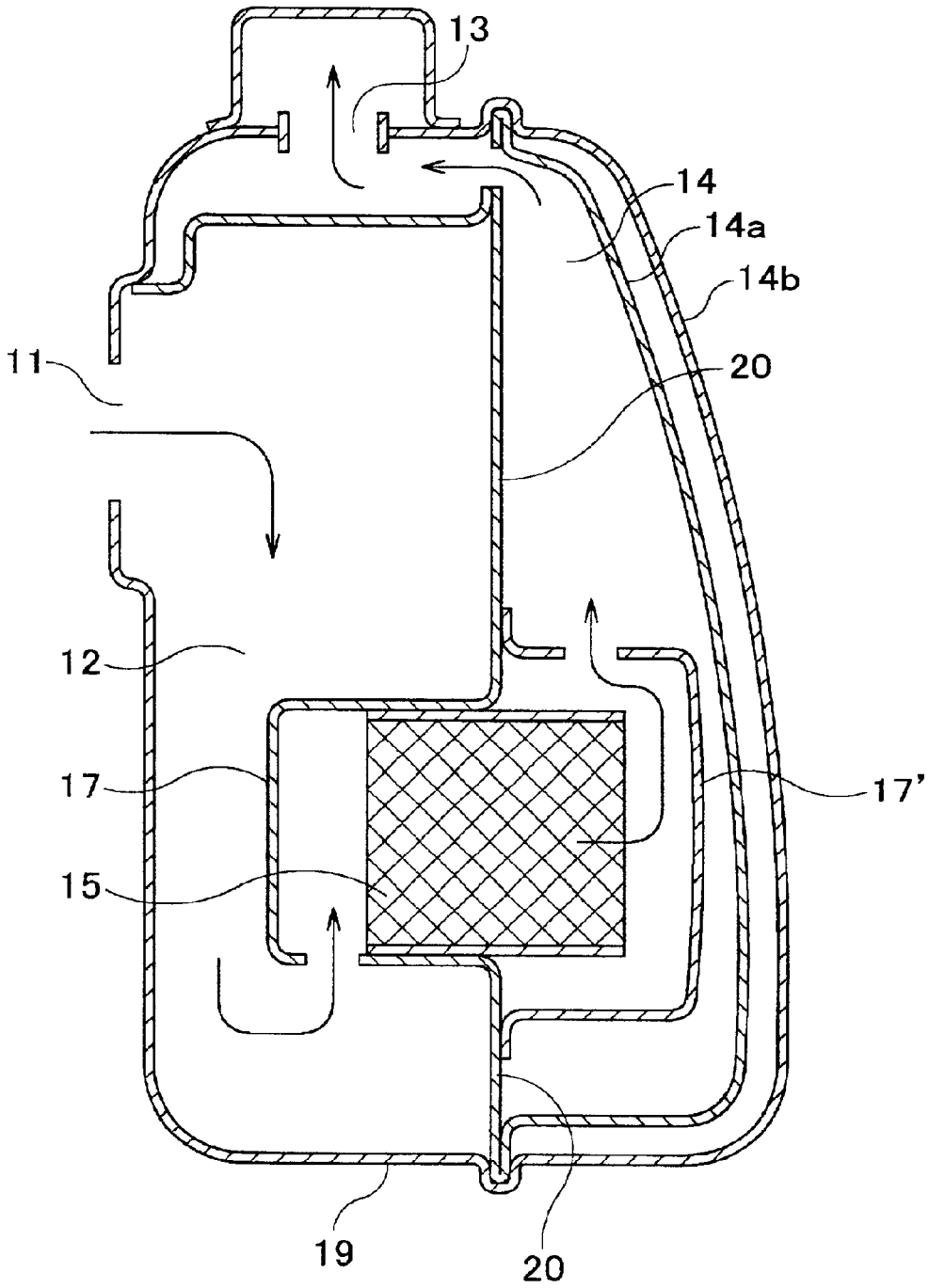
FIG. 6 is a vertical cross sectional view of the engine muffler of another embodiment according to the present invention.

The engine muffler shown in FIG. 6 is manufactured to have a cover plate 17 around the left side of the first gas purifier 15 as illustrated in FIG. 3 to prevent the heat radiation from said first gas purifier 15 and also provide a cover plate 17' around the right side of said first exhaust gas purifier 15 to prevent the heat radiation from said first exhaust gas purifier 15. In this case, it is required to manufacture the partition board 20 and the cover plate 17 as an integral unit to simplify the manufacturing process.

Figure 7:
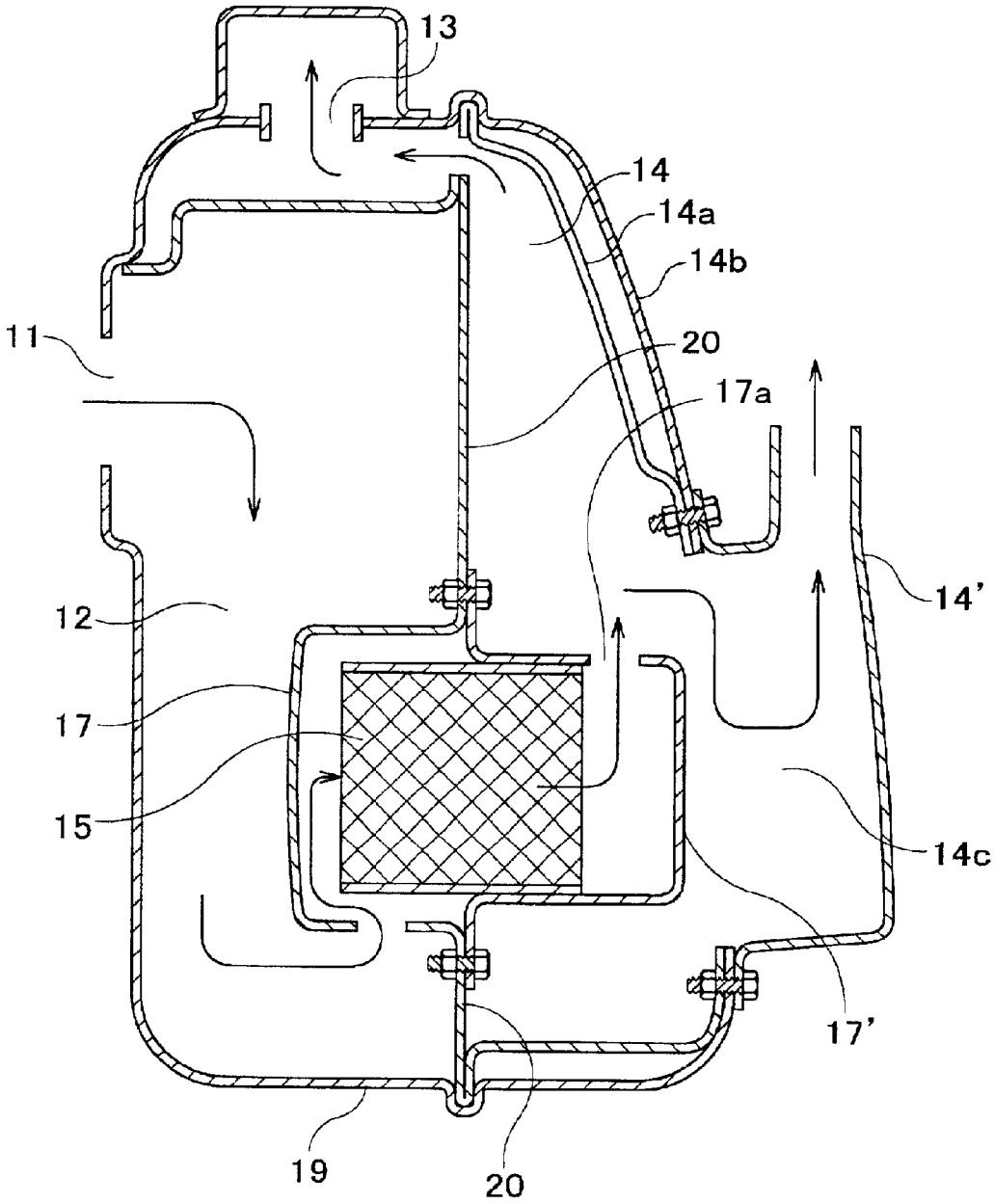
FIG. 7 is a vertical cross sectional view of the engine muffler of another embodiment according to the present invention.

The engine muffler shown in FIG. 7 is the one to improve the construction of the muffler illustrated in FIG. 6. The cover plate 17' in the second exhaust gas expansion chamber 14 is detachably fastened to the partition board 20 with a bolt and a nut. A part of the double walls 14*a* and 14*b* in the second expansion chamber 14 is partly removed to place an exhaust gas introduction outlet 14*c*. A plate 14' of the introduction aperture 14*c* is detachably fastened to the double walls with a bolt and a nut. As inside the muffler is heated up to approximately 700~800 degrees and contaminated with oil. It is recommended to detachably provide the exhaust purifier 15 to the muffler to clean said exhaust gas purifier 15 to take out for replacement or cleaning.

The partition board 20 and the cover plate 17 in the first expansion chamber 12 are made to an integral unit construction, a predetermined distance is provided between the cover plate 17 and the exhaust gas purifier 15. In the meantime, the distance between the cover plate 17' in the second expansion chamber 14 and both sides of the exhaust gas purifier 15 is made nil as shown in the figure. It becomes easier to take out the exhaust gas purifier 15 from the second expansion chamber 14 and also it becomes easier to return the exhaust gas purifier 15 to its original position in the first expansion chamber 12 after cleaning.

Figure 8:
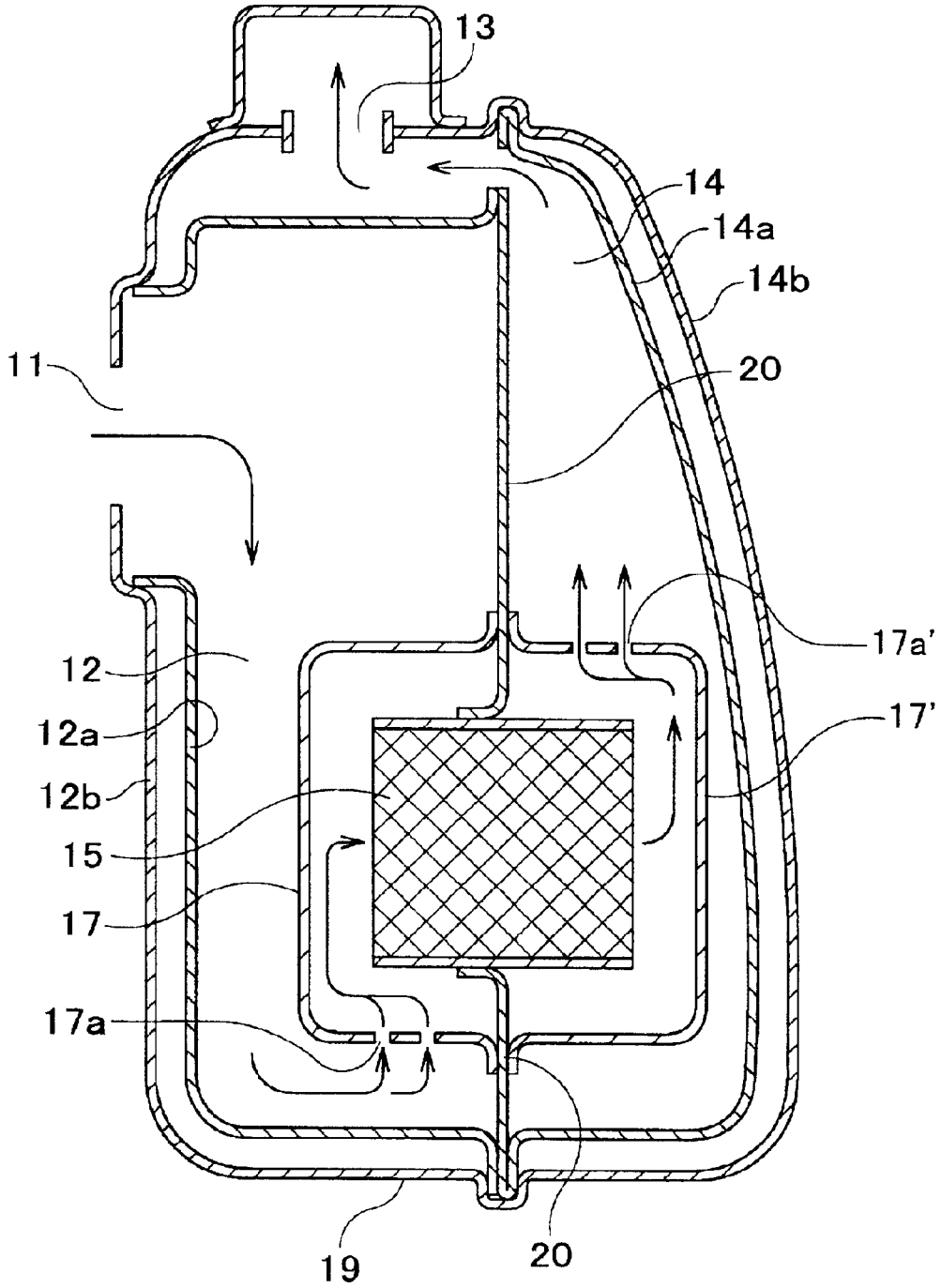
FIG. 8 is a vertical cross sectional view of the engine muffler of another embodiment according to the present invention.
Figure 9:
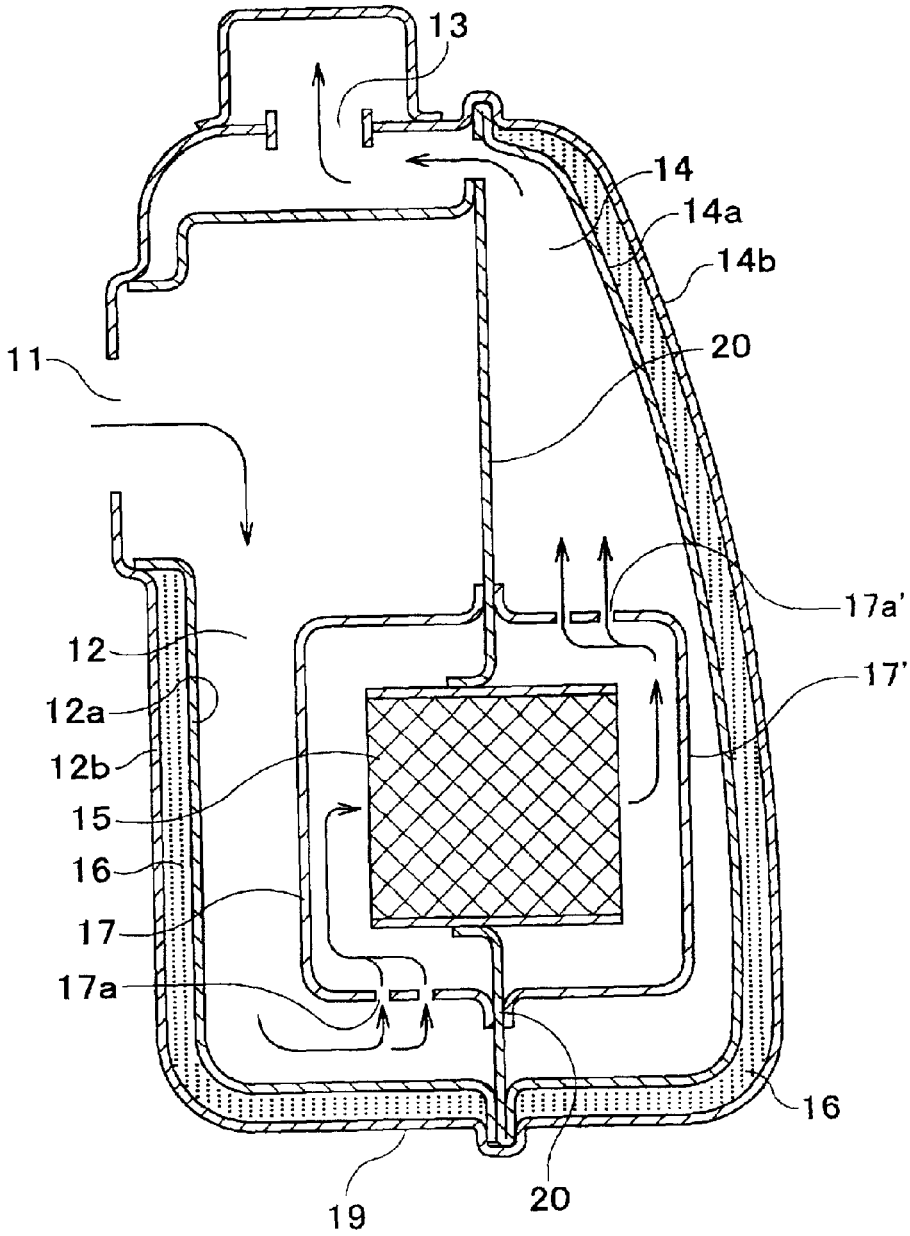
FIG. 9 is a vertical cross sectional view of the engine muffler of another embodiment according to the present invention.

As shown in FIG. 8, it is possible to construct the circumference of the muffler as a double wall construction in addition to the construction that the first gas purifier 15 is surrounded with the cover plates 17 and 17'. It is of course possible to pack the heat insulating material between the double walls as shown in FIG. 9.

It is of course sufficient to limit the double walls in the second expansion chamber 14 that is not the side to face to the engine.

In the case of FIG. 8, the cover plates 17, 17' are made into an integral unit taking into consideration the manufacturing process and interchangeability of the products. It is recommended that the exhausting gas inlet 17*a* of the cover plate 17 is located lower and the gas outlet 17*a'* of the cover plate 17' is located upper.

As aforementioned, it is possible to arrange the flow of the exhaust gas slower to improve purification efficiency of the exhaust gas and sound elimination efficiency as well.

It will be sufficient to have a double wall construction of 14*a* and 14*b* only at the wall in the second expansion chamber 14 to which the engine is not faced to.

As shown in FIG. 9, packing the heat insulating material 16 in the double walls further enhances the heat insulation efficiency. This construction will prevent the heat radiation toward outside the engine.

Figure 10:
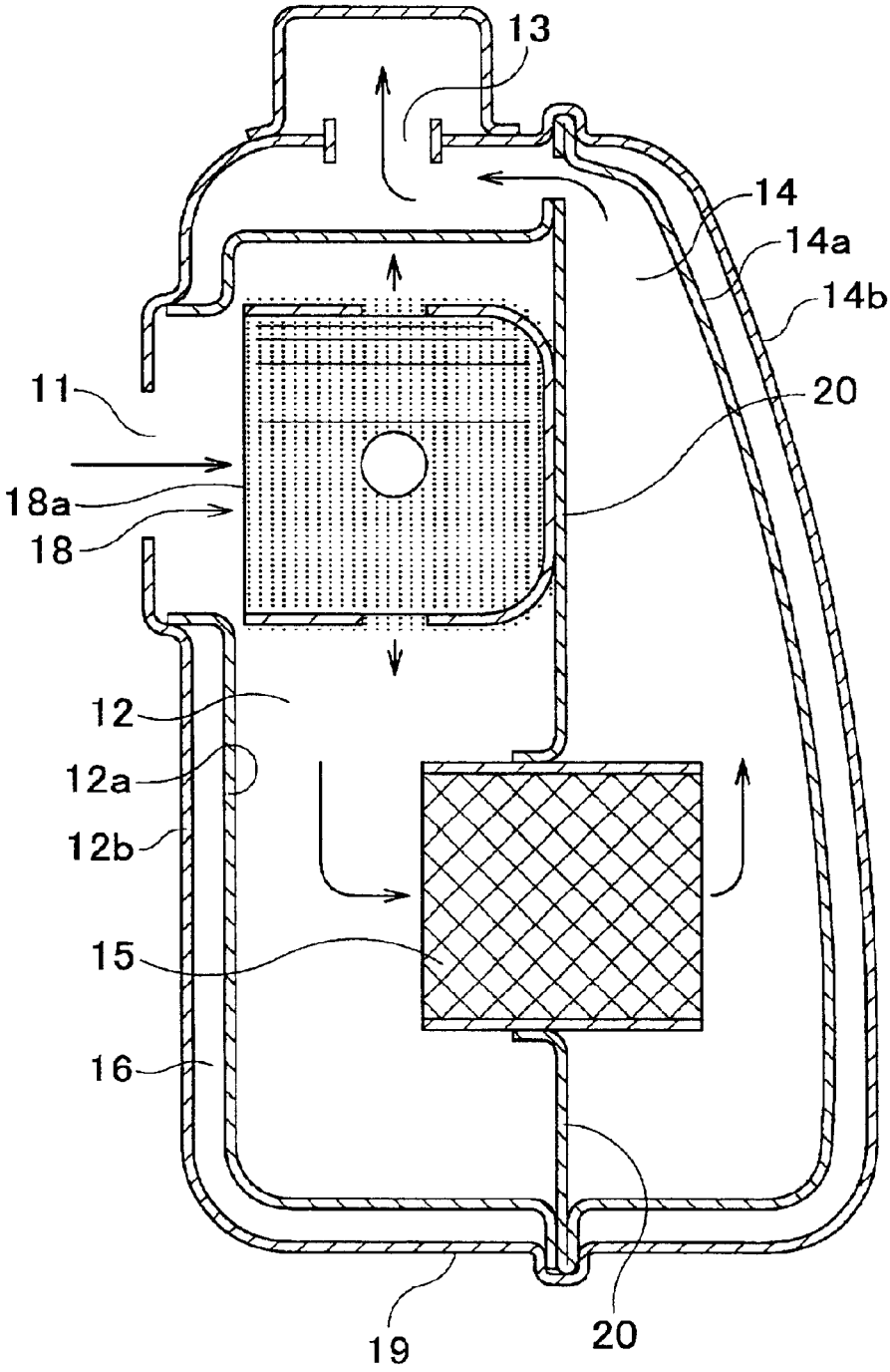
FIG. 10 is a vertical cross sectional view of the engine muffler of another embodiment according to the present invention.
Figure 11:
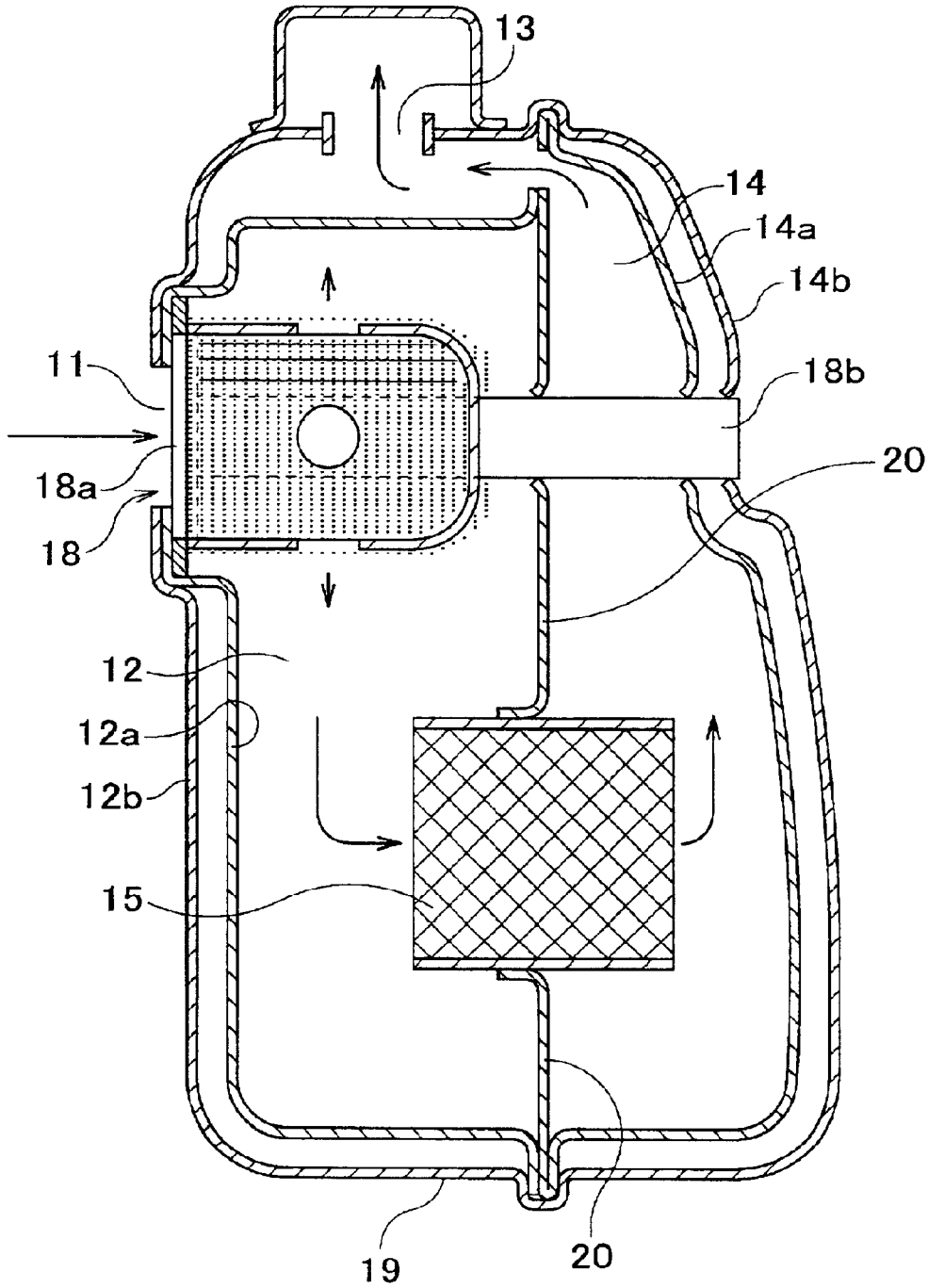
FIG. 11 is a vertical cross sectional view of another embodiment according to the present invention.

As shown in FIG. 10 and FIG. 11, a second exhaust gas purifier 18 coated with a catalyst to purify the exhaust gas on the surface of the purifier provided with a plurality of through holes in addition to the first exhaust gas purifier 15 is recommended.

As explained in FIG. 4B and FIG. 5B, it goes without saying that if there is no particular restriction in the exhaust gas purification concentration degree, it is recommended not to apply the catalyst. The second exhaust gas purifier 18 is coated with the catalyst on its uneven recesses. The cylindrical purifier 18 has one side having an open aperture facing to the exhaust gas inlet 11 is located in the first expansion chamber 12.

As shown in FIG. 10, said second exhaust gas purifier 18 is attached to said partition board 20 by means of welding or, as shown in FIG. 11, the open aperture end of the recessed surface 18*a* is connected to the exhaust gas inlet 11. Further, the rear surface and the front surface of the second exhaust gas purifier 18 to support a supporting bar 18*b* (front side of the supporting bar is not shown) is held and there is the exhausted gas purifier 18 and the partition board 20 to form an exhaust gas passage between the end part of the second gas purifier 18 and the partition board 20.

By installing the second exhaust gas purifier 18, said gas purifier 18 is heated by the exhaust gas. Incomplete combustion gas is heated perfectly and generation of carbon monoxide or nitrogen oxides is decreased and exhaust gas purification work is further improved.

Figure 12:
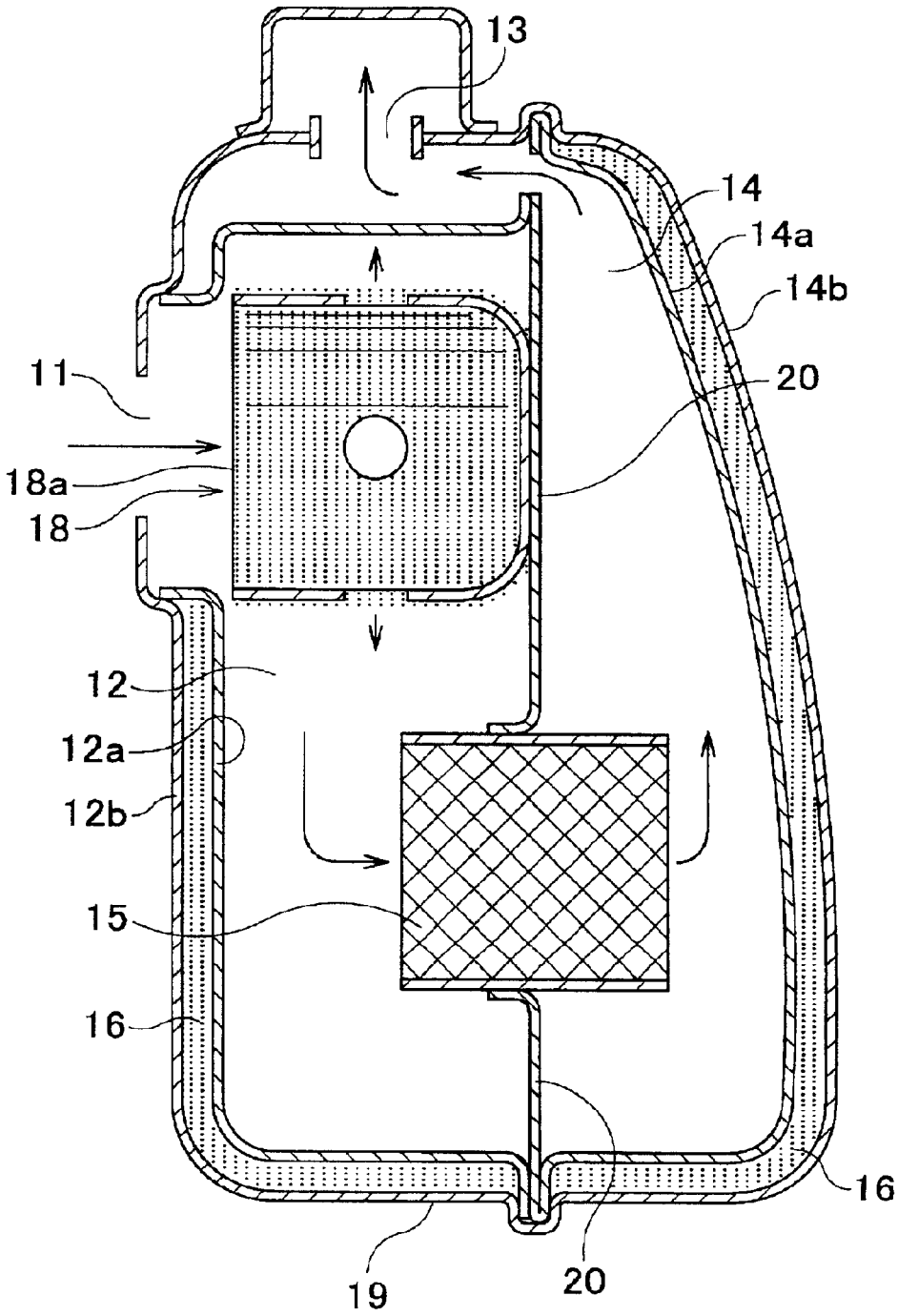
FIG. 12 is a vertical cross sectional view of another embodiment according to the present invention.

Further, as shown in FIG. 12, the heat insulating material 16 selected from a group of the heat insulating materials, such as alumina, glass wool, ceramic wool, mineral fiber, etc. is packed in the double walls. The heat to the double walls is decreased and the heat insulating efficiency is enhanced.

Figure 13:
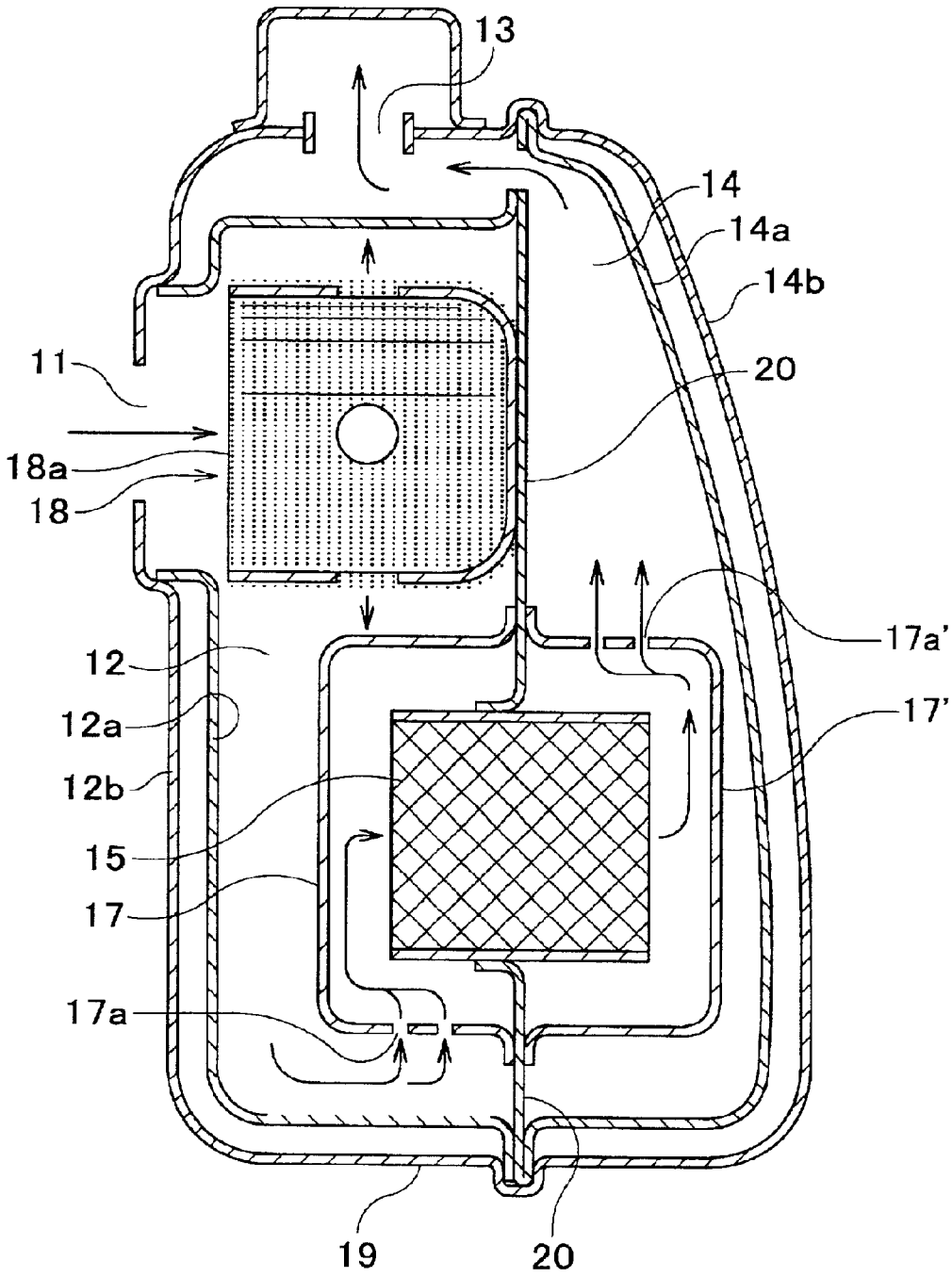
FIG. 13 is a vertical cross sectional view of another embodiment according to the present invention.

As shown in FIG. 13, it is also recommended to cover the first exhaust gas purifier 15 with the cover plates 17, 17' and welding the closed end of the second exhaust gas purifier 18 to the partition board 20 and provide the double walls 12*a*, 12*b* and 14*a*, 14*b* almost around the muffler.

It is convenient to form an integral unit to manufacture the cover plates 17 and 17' taking into consideration of the interchangeability. It is recommended that the flowing entrance 17*a* of the exhaust gas of the cover plate 17 is located lower and a flowing outlet 17*a'* of the exhaust gas of the cover plate 17 is located upper to cover the first exhaust gas purifier 15. Such construction of the attachment of the cover plates 17 and 17' will make the exhaust gas flow slower and exhaust gas purification efficiency by the first exhaust gas purifier 15 will be increased and also sound elimination effect will be enhanced.

Figure 14:
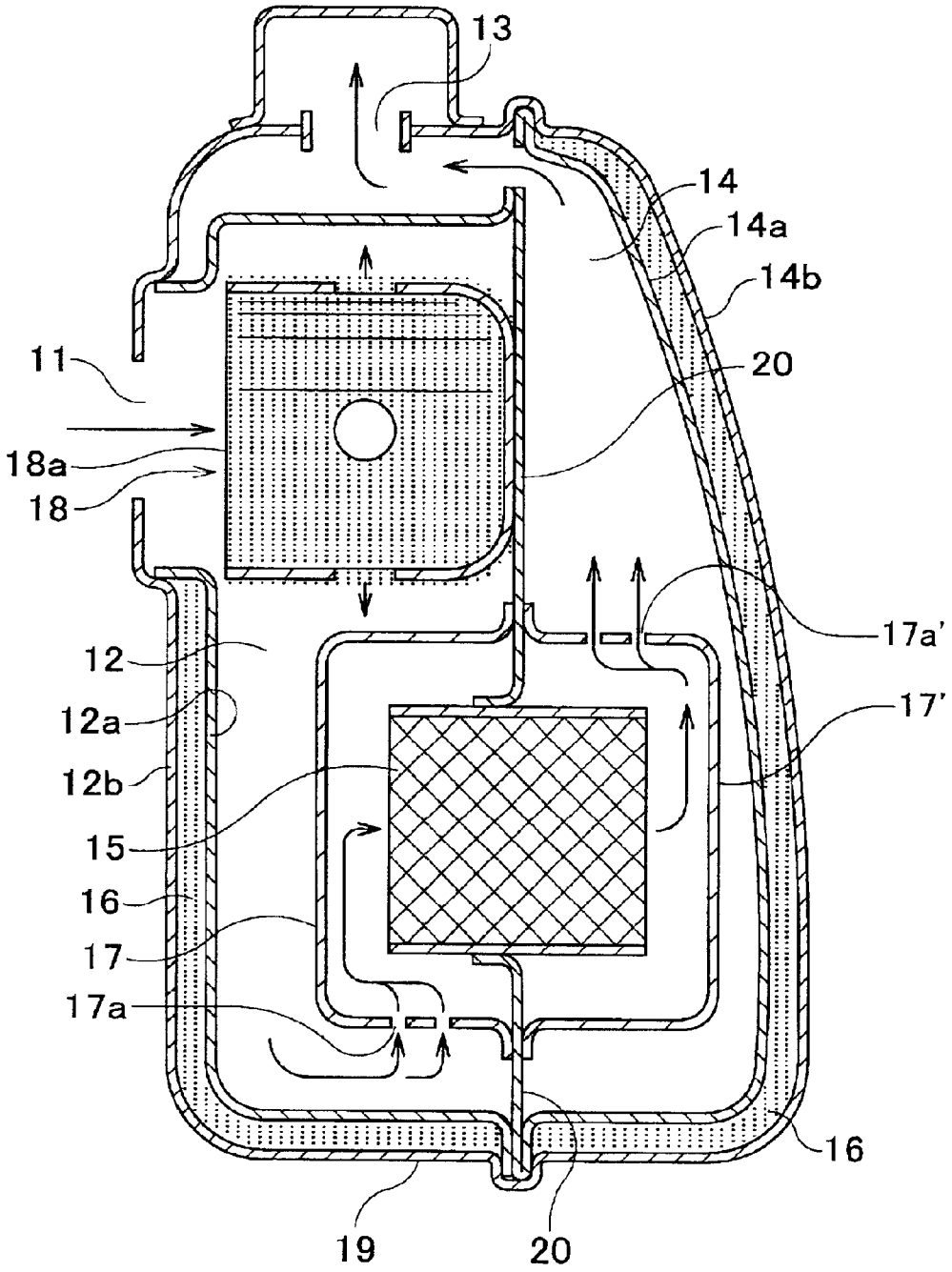
FIG. 14 is a vertical cross sectional view of another embodiment according to the present invention.

Further, as shown in FIG. 14, it is also recommended to fit the heat insulating material 16 such as glass wool between the walls 14*a* and 14*b* of said double walls. This construction will further improve the heat insulating efficiency and decreases the heat transfer toward outside of the double walls 14*a* and 14*b*.

EFFECTS OF THE INVENTION

The present invention has been made with the conventional troubles in mind and manufacture of the muffler with a double-wall construction with a predetermined distance between the wall surfaces in the second expansion chamber of the 2 cycle or the 4 cycle engine. The air between the double walls enhances the heat insulating efficiency to decrease the heat transfer toward the outside placed double-walls construction. The problems occurred in the conventional art such as disturbing decreasing the outside configuration by placing the metallic cover and further place the heat durable plastic cover with a predetermined distance.

The double-wall construction in the second expansion chamber with a predetermined distance is placed on the portion to which the engine is not installed and further the double-wall construction packed with a heat insulating material. This construction makes the heat efficiency larger and decreases transfer of the heat to the outside of the second expansion chamber.

As afore-mentioned, the first expansion chamber of the first exhaust gas purifier is covered with a cover plate having the exhaust gas inlet aperture and also to cover the first exhaust gas purifier in the second expansion chamber side with the cover plate having the exhaust gas outlet aperture, the flow of gas is rectified and retarded and purification efficiency, sound elimination efficiency and heat insulating efficiency by the first exhaust gas purifier is increased.

It is improved to manufacture the cover plate in the first expansion chamber of the first exhaust gas purifier and the partition board in an integral unit and fasten the cover plate in the second expansion chamber with a bolt and a nut and also the outside wall of the second expansion chamber as open construction, the first exhaust gas purifier is detachably installed to take out from the muffler and to return said first exhaust gas purifier to the place where it was located or cleaning. The life of the first exhausting gas purifier becomes longer.

Further, at least the wall of the second expansion chamber to which the engine is not installed and makes the wall to a double-wall construction with a predetermined distance, and further a heat insulating material is packed between the walls, the heat of the double walls outside of said second expansion chamber is further decreased.

What is claimed is:

1. An engine muffler comprising:

a partition board dividing the muffler having a chamber gas inlet aperture connecting to an engine exhaust gas outlet and a chamber gas outlet aperture into a first expansion chamber and a second expansion chamber;

the first expansion chamber having a chamber gas inlet aperture connecting to an engine exhaust gas outlet;

the second expansion chamber having a chamber gas outlet aperture;

a first exhaust gas purifier provided passing through a part of the partition board and extending between the first and the second expansion chambers;

a first cover plate, which has an inlet aperture, covering an upstream portion of the first exhaust gas purifier in the first expansion chamber;

an exhaust gas upstream flow-in portion formed by the partition board, the first exhaust gas purifier and the first cover plate in the first expansion chamber;

a second cover plate, which has an outlet aperture, covering a downstream portion of the first exhaust gas purifier in the second expansion chamber; and an exhaust gas downstream flow-out portion formed by the partition board, the first exhaust gas purifier and the second cover plate in the second expansion chamber;

wherein a wall of at least one of the first expansion chamber and the second expansion chamber has a double wall construction with a predetermined gap interposed therebetween.

2. An engine muffler comprising:

a partition board dividing the muffler having a chamber gas inlet aperture connecting to an engine exhaust gas outlet and a chamber gas outlet aperture into a first expansion chamber and a second expansion chamber;

a main body having the partition board dividing an interior of the main body into the first expansion chamber and the second expansion chamber;

a first exhaust gas purifier provided passing through a part of the partition board and extending between the first and the second expansion chambers;

a first cover plate covering a first portion of the first exhaust gas purifier in the first expansion chamber, wherein the first cover plate and the partition are of a monolithic, one piece construction;

an exhaust gas upstream flow-in portion formed by the partition board, the first exhaust gas purifier and the first cover plate in the first expansion chamber;

a second cover plate covering a second portion of the first exhaust gas purifier in the second expansion chamber, wherein the second cover plate is fastened to the partition with a bolt and a nut;

an exhaust gas downstream flow-out portion formed by the partition board, the first exhaust gas purifier and the second cover plate in the second expansion chamber;

wherein a wall of the second expansion chamber has an opening through which an exhaust gas passing through the first exhaust gas purifier exits to the outside of the muffler, and further the first gas purifier is capable of being taken out for cleaning or replacement.

3. An engine muffler comprising:

a partition board dividing the muffler having a chamber gas inlet aperture connecting to an engine exhaust gas outlet and a chamber gas outlet aperture into a first expansion chamber and a second expansion chamber;

the first expansion chamber having a chamber gas inlet connecting to an engine exhaust gas outlet;

the second expansion chamber having a chamber gas outlet;

a first exhaust gas purifier provided passing through a part of the partition board and extending between the first and the second expansion chambers;

a first cover plate, which has an introduction inlet, covering a first portion of the first exhaust gas purifier in the first expansion chamber;

an exhaust gas upstream flow-in portion formed by the partition board, the first exhaust gas purifier and the first cover plate in the first expansion chamber;

a second cover plate, which has a flow outlet, covering a second portion of the first exhaust gas purifier in the second expansion chamber;

a second exhaust gas purifier provided in the first expansion chamber, wherein the second exhaust gas purifier has an open end facing the engine exhaust gas outlet;

an exhaust gas downstream flow-out portion formed by the partition board, the first exhaust gas purifier and the second cover plate in the second expansion chamber;

wherein a wall of at least one of the first expansion chamber and the second expansion chamber has a double wall construction with a predetermined gap interposed therebetween.

* * * * *